US009833062B1

(12) United States Patent
Smith

(10) Patent No.: US 9,833,062 B1
(45) Date of Patent: Dec. 5, 2017

(54) COLLAPSIBLE TABLE

(71) Applicant: Shannon Denise Smith, Atlanta, GA (US)

(72) Inventor: Shannon Denise Smith, Atlanta, GA (US)

( * ) Notice: Subject to any disclaimer, the term of this patent is extended or adjusted under 35 U.S.C. 154(b) by 0 days.

(21) Appl. No.: 15/367,517

(22) Filed: Dec. 2, 2016

(51) Int. Cl.
*A47B 3/00* (2006.01)
*A47B 9/02* (2006.01)
*A47B 21/03* (2006.01)

(52) U.S. Cl.
CPC ..... *A47B 3/00* (2013.01); *A47B 9/02* (2013.01); *A47B 21/0314* (2013.01); *A47B 2021/0321* (2013.01)

(58) Field of Classification Search
CPC .. A47B 1/056; A47B 1/04; A47B 1/02; A47B 3/12; A47B 3/06; A47B 3/00; A47B 87/002; A47B 12/088; A47B 2003/0806; A47C 4/04; A47C 9/10
USPC ..... 108/115–118, 120, 144.11, 145–147; 248/421, 562, 588, 585, 431, 432, 439, 248/280.11, 292.11, 919, 920, 923
See application file for complete search history.

(56) References Cited

U.S. PATENT DOCUMENTS 2,902,325 A * 9/1959 Koett ..... A47B 3/12 108/124
4,099,469 A * 7/1978 Sahli ..... A47B 3/00 108/1
4,389,946 A * 6/1983 Hwang ..... A47B 3/12 108/115
D323,436 S * 1/1992 Harrison ..... D6/655.14
5,417,168 A * 5/1995 Soper ..... A47B 3/00 108/116
5,460,104 A * 10/1995 Young, Sr. ..... B60N 3/001 108/115
5,732,425 A * 3/1998 Leung ..... A61G 13/06 108/145
6,314,892 B1 * 11/2001 Favini ..... A47B 3/002 108/115
8,726,814 B1 * 5/2014 Matteo ..... A47B 9/16 108/116

OTHER PUBLICATIONS

Live Smart with Hiding Options for Convertible Coffee Table and Chairs, 4BetterHome, available at http://4betterhome.com/convertible-coffee-table-and-chairs/ (Jan. 3, 2017).

(Continued)

*Primary Examiner* — Janet M Wilkens
(74) *Attorney, Agent, or Firm* — McCarter & English, LLP

(57) ABSTRACT

An example collapsible table is described. The collapsible table includes a table top including a top surface and a bottom surface. The collapsible table includes a supporting mechanism coupled to the table top and including a first support assembly and a second support assembly. Each of the first and second support assemblies can be to be disposed in an extended configuration and a collapsed configuration. In the extended configuration, the first and second support assemblies mechanically engage the table top to maintain the table top elevated at an extended height. In the collapsed configuration, the first and second support assemblies collapse to maintain the table top elevated at a collapsed height.

20 Claims, 3 Drawing Sheets

(56) References Cited

OTHER PUBLICATIONS

Creative Images International Hideaway Coffee Table & Reviews, AllModern, available at https://www.allmodern.com/Hideaway-Coffee-Table-CT1266W-VQY1280.html (Jan. 3, 2017).
Round lift coffee table, Houzz, available at http://www.houzz.com/projects/434526/round-lift-coffee-table (Jan. 3, 2017).
Spiderlegs Folding Coffee Table, 28-Inch, Mahogany, Spiderlegs, available at https://www.amazon.com/Spiderlegs-Folding-Coffee-28-Inch-Mahogany/dp/B004ZVTN4E (Jan. 3, 2017).
Pop-up Coffee Table, Ben Riddering shop blog, available at https://benriddering.com/2012/11/14/pop-up-coffee-table-again) (Jan. 3, 2017).
Ingenious Pop Up Latiice Work Coffee Table by Robert van Embricqs, Dayliegrind, available at https://dayliegrind.wordpress.com/2014/08/04/ingenious-pop-up-lattice-word-coffee-table-by-robert-van-embricqs/ (Aug. 4, 2014).
Passo, Resource Furniture, Transforming Tables, Resource Furniture, available at http://resourcefurniture.com/product/passo (Jan. 3, 2017).

* cited by examiner

COLLAPSIBLE TABLE

BACKGROUND

Due to an increase in individuals living in homes having a smaller square footage, furniture design has evolved to become both modular and multi-functional. For example, coffee tables that have variable heights or coffee tables that transform into dining tables are available in the industry. However, such tables remain in the middle of the living room or in front of the couch, taking up valuable space that can be used for other purposes.

SUMMARY

Exemplary embodiments of the present disclosure provide a collapsible table including a table top and a supporting mechanism configured to be disposed in an extended configuration and a collapsed configuration. In the extended configuration, the supporting mechanism maintains the table top at an extended elevation for regular use. In the collapsed configuration, the supporting mechanism folds such that the table top is positioned at a collapsed height (e.g., a fraction of the extended elevation). Thus, in the collapsed configuration, the table can be stored away in various locations, such as underneath a couch or in a closet, to leave unobstructed room for other purposes.

In accordance with embodiments of the present disclosure, an exemplary collapsible table is provided. The table includes a table top including a top surface and a bottom surface. The table includes a supporting mechanism coupled to the table top and including a first support assembly and a second support assembly. Each of the first and second support assemblies can be configured to be disposed in an extended configuration and a collapsed configuration. In the extended configuration, the first and second support assemblies mechanically engage the table top to maintain the table top elevated at an extended height. In the collapsed configuration, the first and second support assemblies collapse (e.g., to a position underneath the bottom surface of the table top) to maintain the table top elevated at a collapsed height.

Each of the first and second support assemblies can include a first support section extending substantially parallel to the bottom surface of the table top. Each of the first and second support assemblies can include a second support section rotatably coupled to the first support section. In some embodiments, the second support section can define a substantially C-shaped configuration. In the collapsed configuration, the second support section can be configured to extend substantially parallel to the bottom surface of the table top.

In the extended configuration, the second support section can be configured to be rotated about or substantially 90 degrees relative to the first support section. The second support section can include a bar extending therefrom. The table top includes a front surface and a rear surface, the rear surface including at least two openings (e.g., substantially circular openings extending into the table top by a partial width). In the extended configuration, the bars of the first and second support assemblies can be configured and dimensioned to fit within the two openings to maintain the table top elevated at the extended height.

In some embodiments, the first support section can include an interior passage and an elongated gap extending along the first support section. The elongated gap includes a first end and a second end defining the limits of travel within the gap. Each of the first and second support assemblies includes a gas spring (e.g., furniture gas springs) including a proximal end and a distal end. The proximal end can be mounted to the bottom surface of the table top. The distal end includes a protrusion attached to a neck. One end of the neck can be configured to slide within a piston cylinder of the gas spring, and the opposing end of the neck includes the protrusion (e.g., a ball). The protrusion can be disposed within the interior passage of the first support section such that the neck extends through the elongated gap, and the distal end of the gas spring can be configured to slide along the elongated gap between the first end and the second end.

In accordance with embodiments of the present disclosure, an exemplary method of operating a collapsible table is provided. The method includes providing the collapsible table as described herein. For example, the collapsible table can include a table top including a top surface and a bottom surface. The collapsible table can include a supporting mechanism coupled to the table top and including a first support assembly and a second support assembly. The method includes positioning the first and second support assemblies in an extended configuration and mechanically engaging the table top with the first and second support assemblies to maintain the table top elevated at an extended height. The method includes positioning the first and second support assemblies in a collapsed configuration by collapsing the first and second support assemblies to maintain the table top elevated at a collapsed height.

Each of the first and second support assemblies can include a first support section extending substantially parallel to the bottom surface of the table top and a second support section rotatably coupled to the first support section. Positioning the first and second support assemblies in the extended configuration can include rotating the second support section about or substantially 90 degrees relative to the first support section. The second support section can include a bar extending therefrom, and the table top can include a rear surface including at least two openings. Mechanically engaging the table top with the first and second support assemblies can include inserting the bars into the two openings to maintain the table top elevated at the extended height. Positioning the first and second support assemblies in the collapsed configuration can include rotating the second support section about or substantially 90 degrees relative to the first support section such that the second support section extends substantially parallel to the bottom surface of the table top.

The first support section can include an interior passage and an elongated gap extending along the first support section. The elongated gap includes a first end and a second end. Each of the first and second support assemblies can include a gas spring including a proximal end and a distal end. The proximal end can be mounted to the bottom surface of the table top, and the distal end includes a protrusion attached to a neck. The protrusion can be movably or slidably disposed within the interior passage of the first support section such that the neck extends through the elongated gap. Positioning the first and second support assemblies in the extended configuration can include sliding the distal end of the gas springs along the elongated gaps from the first end to the second end.

In accordance with embodiments of the present disclosure, an exemplary collapsible table is provided that includes a table top including a top surface, a bottom surface, and a rear surface, the rear surface including at least two openings. The collapsible table includes a supporting mechanism coupled to the table top and including a first support assembly and a second support assembly. Each of the first and second support assemblies can be configured to be disposed in an extended configuration and a collapsed configuration. Each of the first and second support assemblies can include a first support section, a second support section rotatably coupled to the first support section, and a bar extending from the second support section.

In the extended configuration, the second support sections can be rotated relative to the first support sections and the bars can be inserted into the two openings of the table top to maintain the table top elevated at an extended height. In the collapsed configuration, the bars can be disengaged from the two openings of the table top and the second support sections can be rotated relative to the first support sections to maintain the table top elevated at a collapsed height.

In some embodiments, the first support section can include an interior passage and an elongated gap extending along the first support section. The elongated gap can include a first end and a second end. Each of the first and second support assemblies can include a gas spring including a proximal end and a distal end. The proximal end can be mounted to the bottom surface of the table top, and the distal end can include a protrusion attached to a neck. The protrusion can be disposed within the interior passage of the first support section such that the neck extends through the elongated gap. The distal end of the gas spring can be configured to slide along the elongated gap between the first end and the second end.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed collapsible table, reference is made to the accompanying figures, wherein.

DETAILED DESCRIPTION

Exemplary embodiments of the present disclosure provide a collapsible table including a table top and a supporting mechanism configured to be disposed in an extended configuration and a collapsed configuration. In the extended configuration, the supporting mechanism maintains the table top at an extended elevation for regular use. In the collapsed configuration, the supporting mechanism folds such that the table top is positioned at a collapsed height (e.g., a fraction of the extended elevation). Thus, in the collapsed configuration, the table can be stored away in various locations, such as underneath a couch or a closet, to leave unobstructed room for other purposes. The features of the exemplary collapsible table provide for efficient modularity between the collapsed and extended configuration, allowing for convenient use of the table. The term "about" as used herein is defined as any amount equal to or substantially equal to the noted amount.

Figure 1:
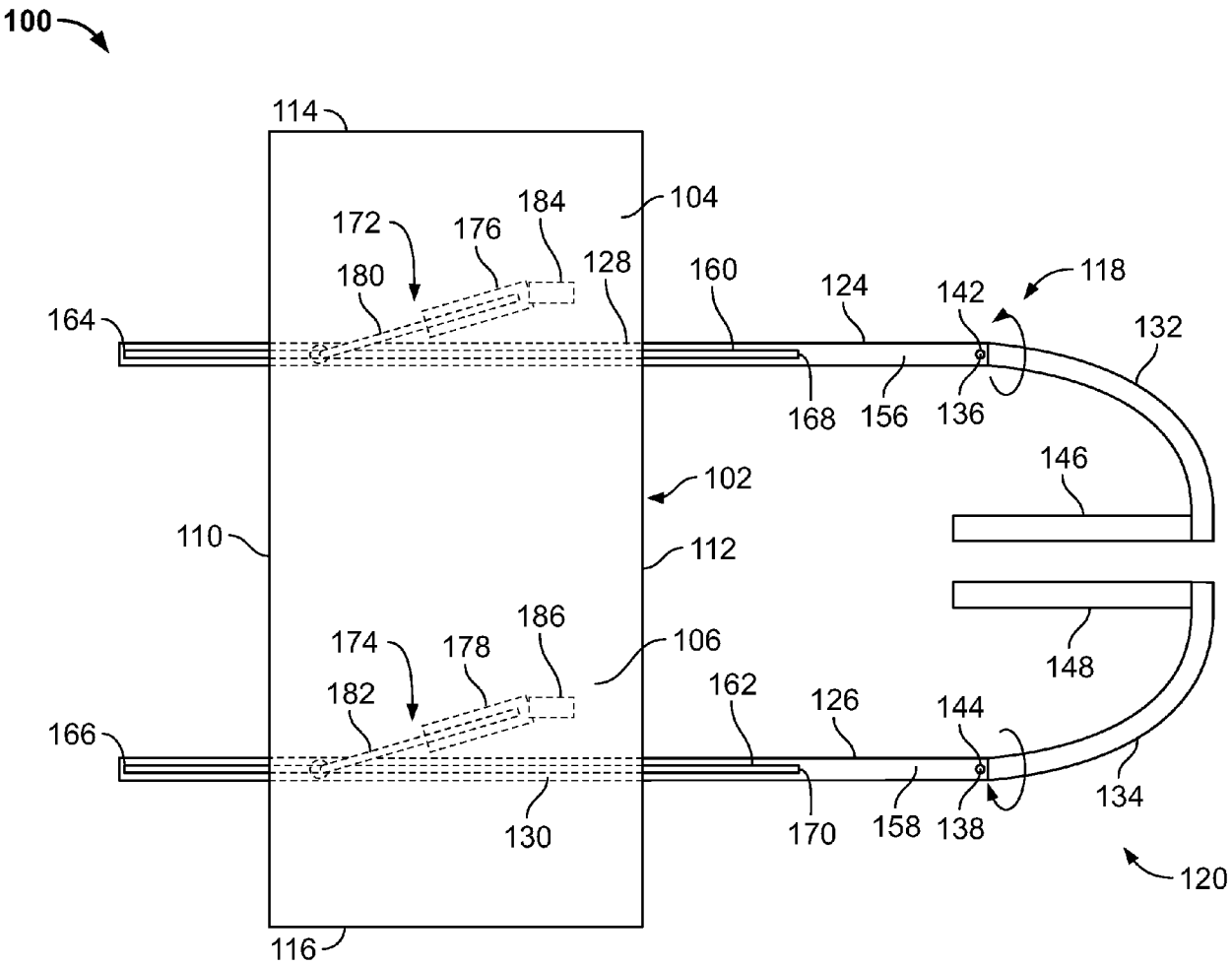
FIG. 1 is a diagrammatic, top view of an exemplary collapsible table of the present disclosure in a collapsed configuration.
Figure 2:
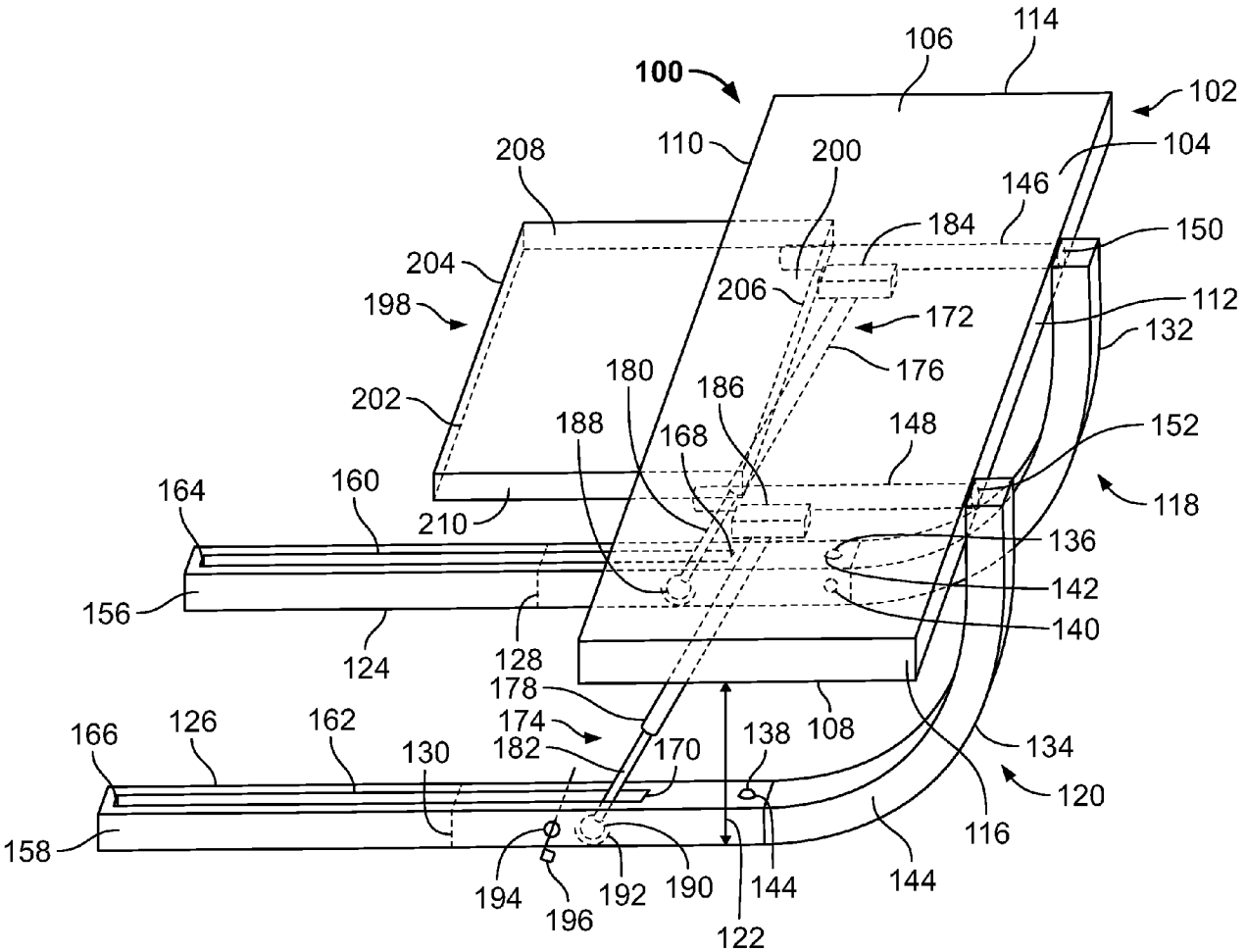
FIG. 2 is a diagrammatic, perspective view of an exemplary collapsible table of the present disclosure in an extended configuration.

FIGS. 1 and 2 are diagrammatic, top and perspective views of an exemplary collapsible table 100 (hereinafter "table 100") of the present disclosure. In particular, FIG. 1 shows the table 100 in a collapsed configuration, and FIG. 2 shows the table 100 in an extended configuration. The table 100 includes a table top 102 configured and dimensioned to support one or more items thereon. Although illustrated as defining a substantially rectangular configuration, it should be understood that the table top 102 can be any configuration, such as rectangular, square, circular, or the like.

The table top 102 generally includes a body 104 with a top surface 106, a bottom surface 108, a front surface 110, a rear surface 112, and first and second sides 114, 116. The top and bottom surfaces 106, 108 define substantially planar surfaces, with the top surface 106 configured to support items thereon. The table top 102 can be fabricated from a variety of materials, such as melamine-coated particleboard, stainless steel, wood, or the like, and can have a variety of finishes and/or colors.

The table 100 includes a supporting mechanism in the form of a first support assembly 118 and a second support assembly 120. The first and second support assemblies 118, 120 can be fabricated from, e.g., metal, wood, plastic, or the like. The first and second support assemblies 118, 120 can be mechanically coupled to the table top 102. Each of the first and second support assemblies 118, 120 is configured to be disposed in an extended configuration (e.g., FIG. 2) and a collapsed configuration (e.g., FIG. 1). As will be discussed in greater detail below, in the extended configuration, the first and second support assemblies 118, 120 mechanically engage the table top 102 to maintain the table top 102 elevated at an extended height 122. In the collapsed configuration, the first and second support assemblies 118, 120 collapse to a position substantially or partially underneath the bottom surface 108 of the table top 102 to position the table top 102 at a collapsed height (e.g., the height of the first and second support assemblies 118, 120 in the collapsed configuration).

The support assemblies 118, 120 each include a first support section 124, 126 extending substantially parallel to the bottom surface 108 of the table top 102. The first support sections 124, 126 define elongated, linear bars or tubes (e.g., square, hollow tubes) configured to be positioned on a supporting surface, such as a floor. Thus, the first support sections 124, 126 can be the only components of the table 100 in contact with the supporting surface when the table 100 is in an extended position.

In some embodiments, the first support sections 124, 126 can each include a single, elongated element. In some embodiments, the first support sections 124, 126 can be telescoping and include at least one partition 128, 130 between first support section halves and second support section halves, such that the first support section halves can linearly extend out of or be retracted into the respective second support section halves allowing the length of the first support sections 124, 126 to be varied. The length of the first support section 124 can be independently varied via the telescoping functionality from the first support section 126. Similarly, the length of the first support section 126 can be independently varied via the telescoping functionality from the first support section 124. The telescoping functionality of the first support sections 124, 126 allows the support assemblies 118, 120 to be adjusted if additional support is needed for the table 100 and/or allows the support assemblies 118, 120 to be collapsed into a more compact configuration for storage of the table 100. In one embodiment, the first support sections 124, 126 can include an engagement or locking mechanism (e.g., multiple spaced openings in the first support section halves and a spring-loaded push button extending from the second support section halves) such that the first and second support section halves can be independently interlocked to maintain the desired length.

The support assemblies 118, 120 each include a second support section 132, 134 hingedly and/or rotatably coupled to the respective first support sections 124, 126. The second support section 132 can be independently rotatable relative to the second support section 134, and the second support section 134 can be independently rotatable relative to the second support section 132. The second support section 132, 134 can define elongated, curved bars with one end rotatably coupled to the respective first support sections 124, 126. In some embodiments, the second support sections 132, 134 define substantially C-shaped configurations. In some embodiments, the second support sections 132, 134 can be coupled to the first support sections 124, 126 via locking mechanisms 136, 138.

The locking mechanism 136, 138 can be in the form of spring-loaded push buttons or pins extending from the second support sections 132, 134 engaged with complementary openings 140, 142, 144 in the first support sections 124, 126. For example, one end of the first support sections 124, 126 can be configured to at least partially concentrically receive an end of the second support sections 132, 134 including the spring-loaded pin. The first support sections 124, 126 each include two openings 140, 142, 144 radially separated by approximately 90 degrees and configured to receive the spring-loaded pin. For example, a first opening 142, 144 can be located in the top wall of the first support sections 124, 126 (as illustrated in the top down view of FIG. 1), and a second opening 140 can be located in the right wall of the first support section 124 and the left wall of the first support section 126 (relative to the top down view of FIG. 2). Although the opening in the left wall of the first support section 126 is not shown, it should be understood that the opening is substantially similar to the opening 140 in the first support section 124 and faces the opening 140. The openings 140 in the right wall of the first support section 124 and the left wall of the first support section 126 therefore both face each other and a central longitudinal axis of the table 100.

The locking mechanism 136, 138 thereby functions to selectively and independently interlock the first support sections 124, 126 with the second support sections 132, 134 in the collapsed configuration or the extended configuration. In the collapsed configuration shown in FIG. 1, the second support sections 132, 134 can extend substantially parallel to the bottom surface 108 of the table top 108, with the C-shaped elements extending or curving towards each other (e.g., towards a central longitudinal axis of the table 100). The spring-loaded pin of the second support section 132 can be engaged with the opening 140 in the right wall of the first support section 124 to maintain the collapsed configuration of the second support section 132. The spring-loaded pin of the second support section 134 can be engaged with an opening in the left wall of the first support section 126 to maintain the collapsed configuration of the second support section 134.

To position the second support sections 132, 134 in the extended configuration, the spring-loaded pin of the second support section 132 can be disengaged from the opening 140, the second support section 132 can be rotated approximately 90 degrees to the position shown in FIG. 2, and the spring-loaded pin can be engaged with an opening 142 in the top wall of the first support section 124. Similarly, the spring-loaded pin of the second support section 134 can be disengaged from the opening in the left wall of the first support section 126, the second support section 134 can be rotated approximately 90 degrees to the position shown in FIG. 2, and the spring-loaded pin can be engaged with an opening 144 in the top wall of the first support section 126. Thus, in the extended configuration, the second support sections 132, 134 extend in a substantially upward, vertical or perpendicular direction relative to the first support sections 124, 126 and substantially parallel relative to each other.

Each second support section 132, 134 includes a rod or bar 146, 148 (e.g., a substantially linear bar, a linear cylindrical bar, or the like) extending from the end opposing the locking mechanism 136, 138. The bars 146, 148 extend perpendicularly from the end of the second support sections 132, 134 and substantially parallel to the first support sections 124, 126 such that the first support sections 124, 126, the second support sections 132, 134, and the bars 146, 148 are substantially aligned along the respective planes defined by the support assemblies 118, 120. The bar 146 can extend from the second support section 132 in the direction of the first support section 124 while remaining parallel to the first support section 124. Similarly, the bar 148 can extend from the second support section 134 in the direction of the first support section 126 while remaining parallel to the first support section 126. In one embodiment, the bars 146, 148 can be telescoping such that the overall length of the bars 146, 148 extending from the second support sections 132, 134 can be independently varied.

The rear surface 112 of the table top 102 includes two spaced openings 150, 152 that extend from the rear surface 112 in the direction of the front surface 110 in a substantially parallel orientation. In particular, the openings 150, 152 extend a partial distance (e.g., approximately 12 inches) from the rear surface 112 in the direction of the front surface 110. In some embodiments, the openings 150, 152 can extend greater than half of the depth of the table top 102. In some embodiments, the openings 150, 152 can extend at least two-thirds of the depth of the table top 102. The distance of the openings 150, 152 can be substantially equal to the length of the bars 146, 148. After the support assemblies 118, 120 have been positioned in the extended configuration (e.g., the second support sections 132, 134 have been rotated into the substantially vertical orientation), the bars 146, 148 can be inserted into the openings 150, 152 up to the second support sections 132, 134 to maintain the table top 102 elevated above the supporting surface at the height 122.

In some embodiments, the table 100 can include an engagement or locking mechanism at the rear surface 112 of the table top 102 and/or at the bars 146, 148 to interlock the bars 146, 148 with the table top 102, thereby preventing disengagement of the table top 102 from the bars 146, 148. In some embodiments, the outer surface of the bars 146, 148 can include a textured or low friction surface that prevents disengagement of the bars 146, 148 from the table top 102. In some embodiments, the weight of the table top 102 can prevent the bars 146, 148 from disengaging from the table top 102.

The first support sections 124, 126 include a hollow, interior passage 156, 158. For example, the first support sections 124, 126 can be formed from a tubular material including the hollow, interior passage 156, 158. The first support sections 124, 126 include an elongated track or gap 160, 162 formed in and extending along the top surface. In some embodiments, the width of the gap 160, 162 can be approximately 4-5 mm. The gap 160, 162 can extend a partial length of the first support section 124, 126, and extends from the top surface into the interior passage 156, 158. Each gap 160, 162 includes a first end 164, 166 and a second end 168, 170 that define the endpoints at which portions of the support assemblies 118, 120 travel, the first end 164, 166 corresponding with the collapsed configuration and the second end 168, 170 corresponding with the extended configuration.

The support assemblies 118, 120 each include a hydraulic or gas spring mechanism 172, 174 mechanically coupled between the bottom surface 108 of the table top 102 and the first support sections 124, 126. Each spring mechanism 172, 174 is configured to provide support to the table top 102 in the extended configuration of the table 100. Although illustrated as having two spring mechanisms 172, 174, one on each side of the table top 102, in some embodiments the table 100 can include two spring mechanisms 172, 174 on each side of the table top 102 to provide additional support. Each spring mechanism 172, 174 includes proximal end and a distal end. The proximal end can be in the form of a dampening cylinder 176, 178 and the distal end can be in the form of a piston or neck 180, 182. The neck 180, 182 slides within the cylinder 176, 178 and the gas or hydraulic action of the cylinder 176, 178 provides the necessary resistance to support the weight of the table top 102. In one embodiment, the spring mechanisms 172, 174 can extend and retract independently of each other. In one embodiment, the spring mechanisms 172, 174 can extend and retract in a substantially coordinated or simultaneous manner.

The proximal end of the spring mechanism 172, 174 can be mounted to the bottom surface 108 of the table top 102 with mounting brackets 184, 186. The connection between the proximal end of the spring mechanism 172, 174 and the mounting bracket 184, 186 can be a hinge or pivoting connection, allowing the angle between the spring mechanism 172, 174 and the table top 102 to vary as the support assembly 118, 120 is oriented from a collapsed configuration to an extended configuration. The distal end of the neck 180, 182 includes a protrusion 188, 190 (e.g., a ball, an approximately 10 mm diameter steel ball socket, or the like) configured and dimensioned to be disposed within the interior passage 156, 158 of the first support section 124, 126. In particular, a portion of the neck 180, 182 can extend through the gap 160, 162 into the interior passage 156, 158 and the protrusion 188, 190 can slide within the interior passage 156, 158. The width or diameter of the protrusion 188, 190 is dimensioned greater than the width of the gap 160, 162, thereby preventing the distal end of the spring mechanism 172, 174 from disengaging the first support section 124, 126.

In some embodiments, the cylinder 176, 178 of the spring mechanism 172, 174 can include an internal locking mechanism allowing the spring mechanism 172, 174 to lock in the extended position (e.g., shown in FIG. 2). In some embodiments, the interior passage 156, 158 can include a groove 192 at or near the second end 168, 170 of the gap 160, 162 into which the protrusion 188, 190 fits corresponding with the fully extended configuration of the table 100. The protrusion 188, 190 can be engaged with the groove 192 to prevent the spring mechanism 172, 174 from sliding towards the first end 164, 166 of the gap 160, 162. In some embodiments, the first support sections 124, 126 can include lateral openings 194 extending from side-to-side, located at or near the second end 168, 170 of the gap 160, 162, and configured to receive a toggle pin 196. Insertion of the pin 196 prevents the spring mechanism 172, 174 from sliding towards the first end 164, 166, thereby maintaining the spring mechanism 172, 174 in the extended configuration.

Thus, in the collapsed configuration, the spring mechanisms 172, 174 can be oriented substantially parallel to the supporting surface or the bottom surface 108 of the table top 102, and the entire height of the collapsed table 100 can be the height of the table top 102, the spring mechanism 172, 174, and the first support section 124, 126. In some embodiments, the table top 102 can rest on top of the spring mechanisms 172, 174 in the collapsed configuration. In some embodiments, the bottom surface 108 of the table top 102 can include cutouts configured to at least partially receive the spring mechanisms 172, 174 to reduce the overall height of the table 100 in the collapsed configuration.

The collapsed height of the table 100 allows the table 100 to be stored in small areas, such as underneath a couch. In some embodiments, the overall collapsed height of the table can be approximately 5 inches, including the height of the table top 102. To deploy the table 100 into the extended position, the table 100 can be pulled out of its storage position and the second support sections 132, 134 are rotated approximately 90 degrees into the substantially vertical orientation. The locking mechanism 136, 138 can be used to securely lock the second support sections 132, 134 in the substantially vertical orientation.

In some embodiments, the table top 102 can include clamps (e.g., C-clamps) to engage the first support section 124, 126 when in the collapsed configuration to prevent the table top 102 from being lifted by the spring mechanisms 172, 174. Disengagement of the clamps allows the spring mechanisms 172, 174 to automatically lift the table top 102 as the cylinder 176, 178 extends the neck 180, 182 from the cylinder 176, 178. As the spring mechanisms 172, 174 lift the table top 102, the neck 180, 182 slides along the gap 160, 162 from the first end 164, 166 in the direction of the second end 168, 170. In some embodiments, a toggle pin or alternative locking mechanism can be used to prevent the spring mechanism 172, 174 from collapsing from a maximum expanded height. The fully deployed length of the spring mechanisms 172, 174 defines the maximum height 122 or elevation of the table top 102 relative to the supporting surface.

Upon reaching the maximum height with the support of the spring mechanisms 172, 174, the bars 146, 148 are inserted into the openings 150, 152 at the rear surface 112 of the table top 102. As the bars 146, 148 are inserted into the openings 150, 152, the neck 180, 182 slides up to or near the second end 168, 170. The pin 196 (or another locking mechanism) can be used to lock the spring mechanisms 172, 174 in place and prevent lowering of the table top 102 or sliding of the spring mechanism 172, 174 along the gap 160, 162. In some embodiments, the table top 102 can include a cam lock to prevent the table top 102 from sliding backwards into the collapsed configuration. The spring mechanisms 172, 174 and the support assemblies 118, 120 thereby support the table top 102 at the expanded elevation or height 122. In some embodiments, the expanded height 122 can be approximately 20 inches or more.

In some embodiments, in the expanded configuration, the spring mechanisms 172, 174 can extend substantially perpendicularly to the first support sections 124, 126. In some embodiments, in the expanded configuration, the spring mechanisms 172, 174 can extend at an angle relative to the first support sections 124, 126 (e.g., angled towards the bars 146, 148). The angled configuration of the spring mechanisms 172, 174 can provide structural support to the table top 102 by urging the table top 102 in the direction of the second support sections 132, 134, while the bars 146, 148 and second support sections 132, 134 provide support in the opposite direction, thereby stabilizing the table top 102.

To collapse the table 100, the cam lock or locking pins are disengaged from the table top 102, and the bars 146, 148 are removed from the openings 150, 152. The pins 196 (or alternative locking mechanism) are removed to allow the spring mechanism 172, 174 to slide towards the first end 164, 166. The table top 102 can be steadied by the user as the spring mechanisms 172, 174 gradually allow the table top 102 to lower. As the table top lowers 102, the spring mechanism 172, 174 retract and slide into a substantially parallel configuration relative to the bottom surface 108 of the table top 102. The second support sections 132, 134 can be rotated substantially 90 degrees into one or more substantially parallel configurations relative to the bottom surface 108 of the table top 102. The collapsed table 100 can further be slid into a storage area.

In some embodiments, as shown in FIG. 2, the table 100 can include a pull out insert 198 that can be slidably extended from the table top 102. For example, the insert 198 can be extended for use as a computer or keyboard support. The insert 198 generally defines planar top and bottom surfaces 200, 202. The insert 198 further includes a front surface 204, a rear surface 206, and first and second side surfaces 208, 210. In some embodiments, the insert 198 can be a smaller version of the table top 102, and defines a substantially rectangular support surface. The table 100 can include mounting tracks securing the insert 198 to the bottom surface 108 of the table top 102 such that the insert 198 can be slid out from under the table top 102 for use. In some embodiments, the front surface 110 of the table top 102 can include a cutout configured and dimensioned to receive the insert 198 therein. In such embodiments, the insert 198 can be slid out of the cutout for use, and retracted into the cutout for storage.

Figure 3:
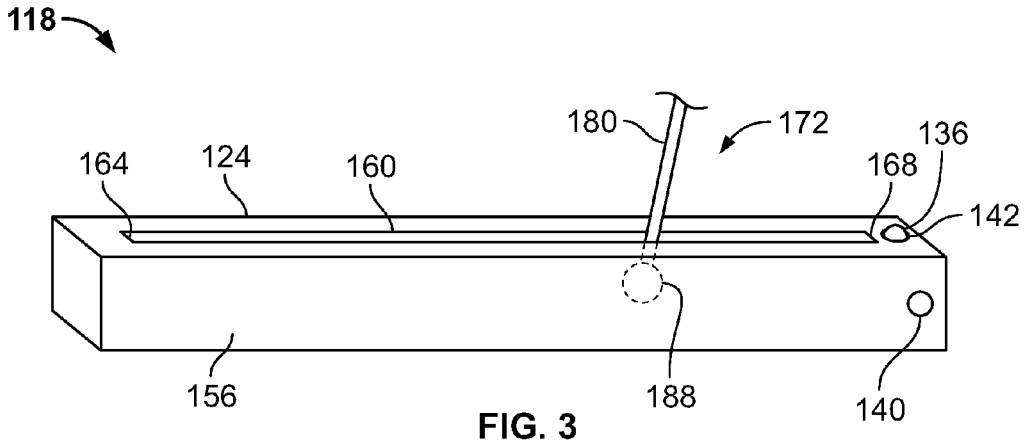
FIG. 3 is a diagrammatic, perspective view of a first support section and a gas spring of an exemplary collapsible table of the present disclosure.

FIG. 3 is a diagrammatic, perspective and partial view of the support assembly 118. As noted above, the first support section includes the hollow, interior passage 156 with the elongated gap 160 formed in the top surface and extending into the interior passage 156. The spring mechanism 172 includes the neck 180 with the protrusion 188 in the form of a ball. The ball has a diameter dimensioned greater than the width of the gap 160, thereby preventing the ball from passing through the gap 160 and out of the interior passage 156. The spring mechanism 172 slides along the gap 160 from the first end 164 (e.g., corresponding to the collapsed configuration) to the second end 168 (e.g., corresponding to the extended configuration).

The end nearest the second end 168 of the gap 168 includes the opening 142 formed in the top surface and the opening 140 formed in the right surface. The opening 142 engages with the locking mechanism 136 (e.g., spring-loaded pin) of the second support section 132 when the second support section 132 is rotated into the extended configuration, and the opening 140 engages with the locking mechanism 136 of the second support section 132 when the second support section 132 is rotated into the collapsed configuration.

Figure 4:
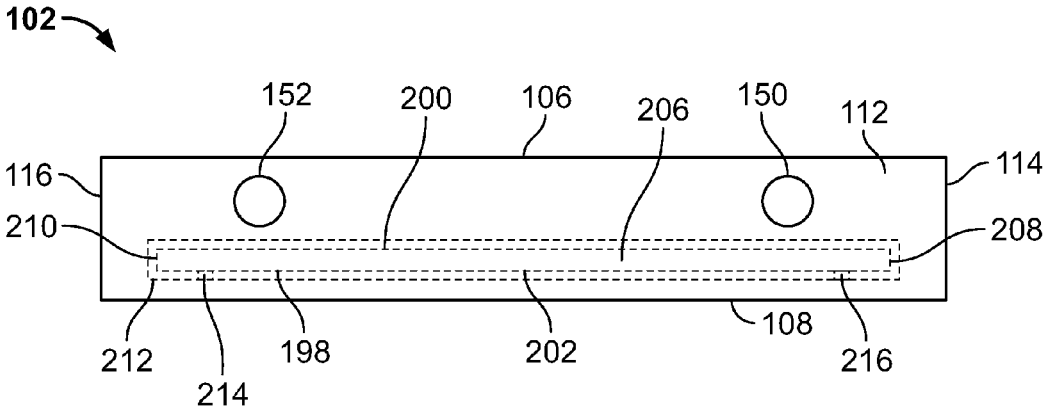
FIG. 4 is a diagrammatic, rear view of a table top of an exemplary collapsible table of the present disclosure.

FIG. 4 is a diagrammatic, rear view of the table top 102 with one variation of the insert 198. In particular, the table top 102 includes a cutout 212 extending a partial distance from the front surface 110 in the direction of the rear surface 112. The cutout 212 can be configured and dimensioned to at least partially receive therein the insert 198. In some embodiments, the insert 198 can define a substantially rectangular, planar configuration, and the cutout 212 defines a similar configuration having a greater width, height and depth to receive the insert 198. In some embodiments, sliding tracks 214, 216 can mount the bottom surface 202 of the insert 198 to an inner surface of the cutout 212. The insert 198 can thereby slide out of the cutout 212 along the sliding tracks 214, 216 into an extended position for use, and can be retracted along the sliding tracks 214, 216 into the cutout 212 for storage.

Figure 5:
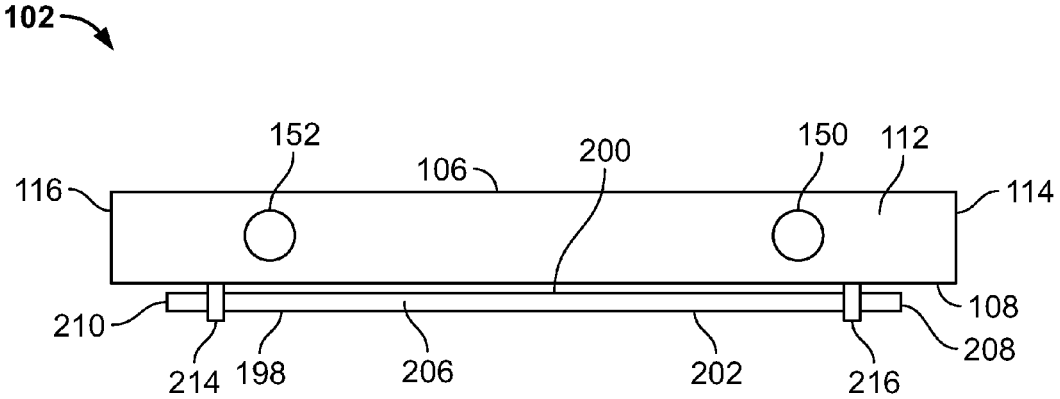
FIG. 5 is a diagrammatic, rear view of a table to of an exemplary collapsible table of the present disclosure.

FIG. 5 is a diagrammatic, rear view of the table top 102 with another variation of the insert 198. In particular, rather than including the cutout 212, the table top 102 includes the insert 198 slidably mounted to the bottom surface 108 of the table top 102. The table top 102 includes sliding tracks 214, 216 mounted to the bottom surface 108 and engaged with at least one of the surfaces of the insert 198. The insert 198 can thereby slide out from under the table top 102 along the sliding tracks 214, 216 into an extended position for use, and can be retracted along the sliding tracks 214, 216 to a position substantially under the table top 102 for storage.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A collapsible table, comprising:

a table top comprising a top surface, a bottom surface, a front surface, and a rear surface; and a supporting mechanism coupled to the table top and comprising a first support assembly and a second support assembly, each of the first and second support assemblies configured to be disposed in an extended configuration and a collapsed configuration;

wherein the table top comprises two or more openings in the rear surface of the table top;

wherein in the extended configuration, the first and second support assemblies mechanically engage the two or more openings of the table top to maintain the table top elevated at an extended height; and wherein in the collapsed configuration, the first and second support assemblies collapse to position the table top at a collapsed height.

2. The collapsible table of claim 1, wherein each of the first and second support assemblies comprises a first support section extending substantially parallel to the bottom surface of the table top.

3. The collapsible table of claim 2, wherein each of the first and second support assemblies comprises a second support section rotatably coupled to the first support section.

4. The collapsible table of claim 3, wherein the second support section defines a C-shaped configuration.

5. The collapsible table of claim 3, wherein in the collapsed configuration, the second support section is configured to extend substantially parallel to the bottom surface of the table top.

6. The collapsible table of claim 3, wherein in the extended configuration, the second support section is configured to be rotated about 90 degrees relative to the first support section.

7. The collapsible table of claim 3, wherein each second support section comprises a bar extending therefrom.

8. The collapsible table of claim 2, wherein the first support section comprises an interior passage and an elongated gap extending along the first support section, the elongated gap comprising a first end and a second end.

9. The collapsible table of claim 8, wherein each of the first and second support assemblies comprises a gas spring including a proximal end and a distal end, the proximal end mounted to the bottom surface of the table top, and the distal end comprising a protrusion attached to a neck.

10. The collapsible table of claim 9, wherein the protrusion is disposed within the interior passage of the first support section, the neck extends through the elongated gap, and the distal end of the gas spring is configured to slide along the elongated gap between the first end and the second end.

11. The collapsible table of claim 1, wherein in the extended configuration, the bars of the first and second support assemblies fit within the two openings to maintain the table top elevated at the extended height.

12. A method of operating a collapsible table, comprising:

providing the collapsible table comprising (i) a table top comprising a top surface, a bottom surface, a front surface, and a rear surface, and further comprising two or more openings in the rear surface of the table top and (ii) a supporting mechanism coupled to the table top and comprising a first support assembly and a second support assembly;

positioning the first and second support assemblies in an extended configuration and mechanically engaging the two or more openings of the table top with the first and second support assemblies to maintain the table top elevated at an extended height; and positioning the first and second support assemblies in a collapsed configuration by collapsing the first and second support assemblies to position the table top at a collapsed height.

13. The method of claim 12, wherein each of the first and second support assemblies comprises a first support section extending substantially parallel to the bottom surface of the table top and a second support section rotatably coupled to the first support section, and positioning the first and second support assemblies in the extended configuration comprises rotating the second support section about 90 degrees relative to the first support section.

14. The method of claim 13, wherein the second support section comprises a bar extending therefrom, mechanically engaging the two or more openings of the table top with the first and second support assemblies comprises inserting the bars into the two openings to maintain the table top elevated at the extended height.

15. The method of claim 13, wherein the first support section comprises an interior passage and an elongated gap extending along the first support section, the elongated gap comprising a first end and a second end, and wherein each of the first and second support assemblies comprises a gas spring comprising a proximal end and a distal end, the proximal end mounted to the bottom surface of the table top, and the distal end comprising a protrusion attached to a neck.

16. The method of claim 15, wherein the protrusion is disposed within the interior passage of the first support section, the neck extends through the elongated gap, and positioning the first and second support assemblies in the extended configuration comprises sliding the distal end of the gas springs along the elongated gaps from the first end to the second end.

17. The method of claim 12, wherein each of the first and second support assemblies comprises a first support section extending substantially parallel to the bottom surface of the table top and a second support section rotatably coupled to the first support section, and positioning the first and second support assemblies in the collapsed configuration comprises rotating the second support section about 90 degrees relative to the first support section such that the second support section extends substantially parallel to the bottom surface of the table top.

18. A collapsible table, comprising:

a table top comprising a top surface, a bottom surface, and a rear surface, the rear surface comprising two or more openings; and a supporting mechanism coupled to the table top and comprising a first support assembly and a second support assembly, each of the first and second support assemblies configured to be disposed in an extended configuration and a collapsed configuration and comprising a first support section, a second support section rotatably coupled to the first support section, and a bar extending from the second support section;

wherein in the extended configuration, the second support sections are rotated relative to the first support sections and the bars are inserted into the two openings of the table top to maintain the table top elevated at an extended height; and wherein in the collapsed configuration, the bars are disengaged from the two openings of the table top and the second support sections are rotated relative to the first support sections to position the table top at a collapsed height.

19. The collapsible table of claim 18, wherein:

the first support section comprises an interior passage and an elongated gap extending along the first support section, the elongated gap comprising a first end and a second end;

each of the first and second support assemblies comprises a gas spring comprising a proximal end and a distal end, the proximal end mounted to the bottom surface of the table top, and the distal end comprising a protrusion attached to a neck; and the protrusion is disposed within the interior passage of the first support section, the neck extends through the elongated gap, and the distal end of the gas spring is configured to slide along the elongated gap between the first end and the second end.

20. A collapsible table, comprising:

a table top comprising a top surface and a bottom surface; and a supporting mechanism coupled to the table top and comprising a first support assembly and a second support assembly, each of the first and second support assemblies configured to be disposed in an extended configuration and a collapsed configuration;

wherein the first and second support assemblies each comprise a first support section having a hollow interior passage;

wherein the first and second support assemblies each comprise a mechanism mounted at a proximal end to the bottom surface of the table top and slidably disposed within the hollow interior passage of the first support section at a distal end;

wherein in the extended configuration, the first and second support assemblies mechanically engage the table top to maintain the table top elevated at an extended height; and wherein in the collapsed configuration, the first and second support assemblies collapse to position the table top at a collapsed height.

* * * * *